United States Patent [19]

Gebert

[11] Patent Number: 4,594,738

[45] Date of Patent: Jun. 17, 1986

[54] DRAIN AND OVERFLOW DEVICE FOR BATHTUBS

[75] Inventor: Stephan Gebert, La Porte, Ind.

[73] Assignee: Geberit AG, Jona, Switzerland

[21] Appl. No.: 525,537

[22] Filed: Aug. 23, 1983

[30] Foreign Application Priority Data

Sep. 20, 1982 [CH] Switzerland ..... 5545/82

[51] Int. Cl.[4] ..... E03C 1/24

[52] U.S. Cl. ..... 4/199; 4/198; 74/501 R; 251/294

[58] Field of Search ..... 4/198, 199, 200, 202, 4/203, 204, 651, DIG. 16, 191; 74/501 R; 251/294

[56] References Cited

FOREIGN PATENT DOCUMENTS

| | | | |
|---|---|---|---|
| 2755414 | 4/1979 | Fed. Rep. of Germany | 4/199 |
| 1068242 | 6/1954 | France | 251/294 |
| 549701 | 3/1972 | Switzerland . | |
| 188899 | 11/1922 | United Kingdom | 251/294 |
| 1559645 | 1/1980 | United Kingdom | 285/57 |

*Primary Examiner*—Stephen Marcus
*Assistant Examiner*—Linda J. Sholl
*Attorney, Agent, or Firm*—Pollock, Vande Sande & Priddy

[57] ABSTRACT

A drain and overflow device for bathtubs having overflows at different heights and various slopes. By rotation of a turning knob (6) adjacent the overflow housing (15), the body (8) of the drain valve (1) can be raised and lowered by means of a Bowden draw tube (10). A bellows (5) is inserted in the overflow conduit (11), and this enables adjustment of the length of the latter and orientation of the overflow housing (15) to the dimensions of the bathtub. In order to prevent twisting of the Bowden cable (12) during actuation of the turning knob (6), the cable is rotatably arranged on a cable bolt (28). For this purpose, an easily rotatable bearing (34) is inserted in an axial bore (33) of the cable bolt (28), and on this bearing rests a disc (36) to which the Bowden cable is attached.

3 Claims, 5 Drawing Figures

DRAIN AND OVERFLOW DEVICE FOR BATHTUBS

SUMMARY OF THE INVENTION

The invention relates to a drain and overflow device for bathtubs.

BACKGROUND OF THE INVENTION

Drain and overflow devices must be mounted on bathtubs having overflows at different heights. In the drain device known from Swiss Patent No. 549,701, an overflow pipe which is telescopically extendible is provided for this purpose. However, such an overflow pipe has only limited adaptation to bathtubs with unusual slopes. A further disadvantage with prior art devices of this type is the twisting of the Bowden cable during operation, which causes imprecise positioning.

OBJECTION OF THE INVENTION

It is an object of the invention to provide a drain and overflow device of the type described above which can be installed in bathtubs of differing dimensions, and which assures precise positioning of the drain valve.

BRIEF DESCRIPTION OF THE DRAWINGS

In order that the invention may be more clearly understood, reference will now be made to the accompanying drawings, in which an embodiment of the invention is shown for purposes of illustration, and in which.

DESCRIPTION OF PREFERRED EMBODIMENT

Figure 1:
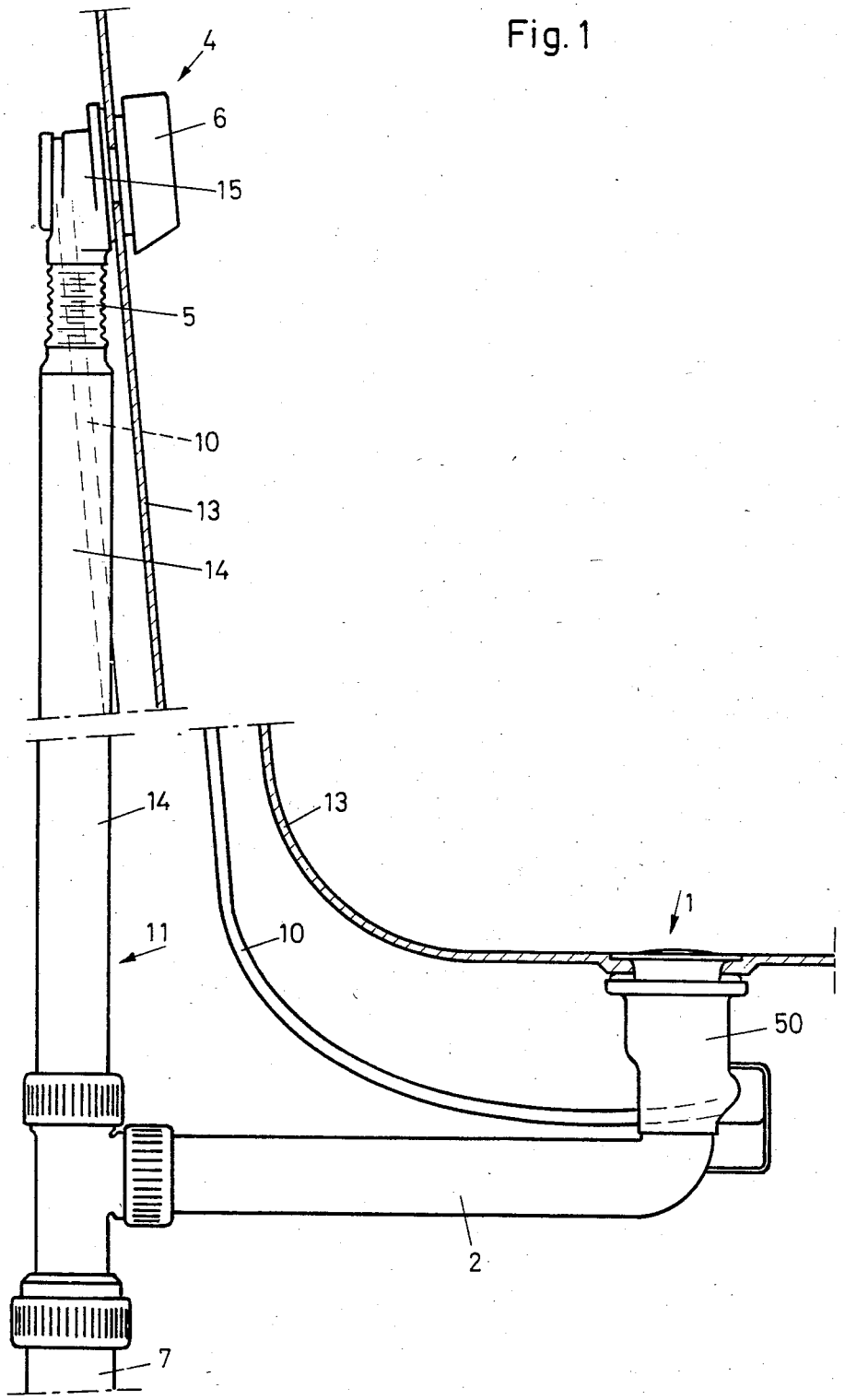
FIG. 1 is a front elevation, partly in section, of a bathtub and the drain and overflow device according to the invention.

FIG. 1 shows a drain and overflow device mounted on a bathtub 13. Drain valve 1 can be opened and closed through turning movements of a turn knob 6, the positioning movements taking place via a Bowden draw tube 10. The overflow conduit 11 and the drain conduit 2 lead to a joint collection conduit 7, which is provided with an odor seal (not shown).

Overflow conduit 11 consists of an overflow pipe 14 and a bellows 5, which is inserted between the overflow pipe 14 and the overflow housing 15.

The flexible bellows 5 enables adaptation of the length of overflow conduit 14 and orientation of the overflow housing 15 even to bathtubs having unusual dimensions.

Figure 2:
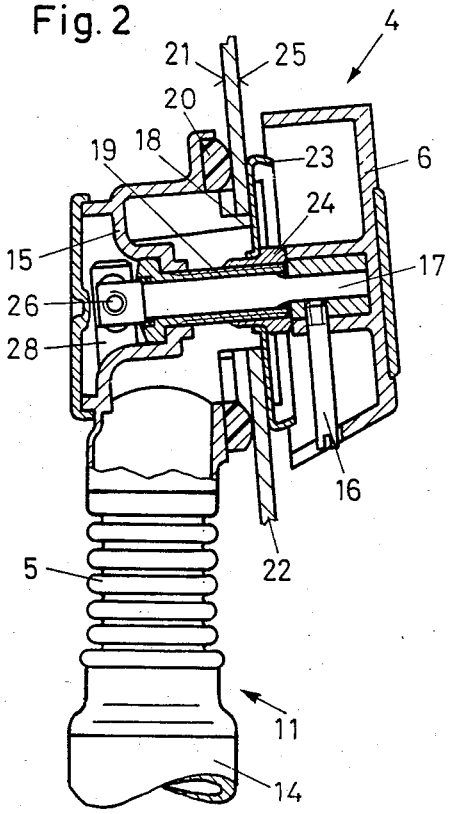
FIG. 2 is a side view partly in section, of the overflow device.
Figure 3:
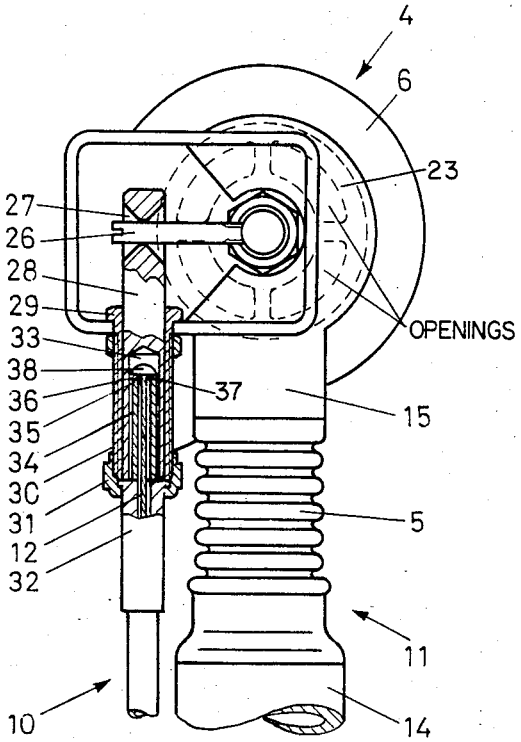
FIG. 3 is a rear view, partly in axial section, of the overflow device.

As shown in FIGS. 2 and 3, the bathtub has an overflow opening 18 to which is connected, in a manner known per se, an overflow device 4. Turning knob 6 is attached by means of a set screw 16 to a shaft 17 which is easily rotatable in a central casing 19. The latter screws the overflow housing 15, which abuts the rear side 21 of the tub wall 22 by way of a seal ring 20, to an overflow cover 23, which is forced against the outer side 25 of the tub wall 22 by a nut 24.

Attached to the rear end of shaft 17 is a perpendicularly projecting lever 26, the free end of which protrudes into a double conical bore 27 of a cable bolt 28 to which the cable 12 of the Bowden draw tube 10 is operably connected. Cable bolt 28 is axially slidable in a casing 29 with an exterior threading 30, which is attached at one end to overflow housing 15, and at the other end, by means of a retaining nut 31, to the jacket 32 of Bowden draw tube 10. In an axial bore 33 of cable bolt 28, an easily rotatable bearing 34 is inserted, on the inner transverse plane 35 of which a disc 36 with a central recess 37 is provided, through which the overflow side end of the Bowden cable 12 is inserted. A spherical enlargement 38 prevents tearing out of the Bowden cable 12.

Upon turning of cable bolt 28, the Bowden cable is not turned along, since the latter is rotatable with respect to disc 36, and bearing 34 with respect to cable bolt 28. Axial rotatable attachment of Bowden cable 12 is also assured when bearing 34 is secured in bore 33 of cable bolt 28, or when Bowden cable 12 is non-rotatably connected with disc 36. Rotatable attachment of Bowden cable 12 assures that, upon actuation of turning knob 6, Bowden cable 12 does not turn, which would reduce the degree of lifting.

Figure 4:
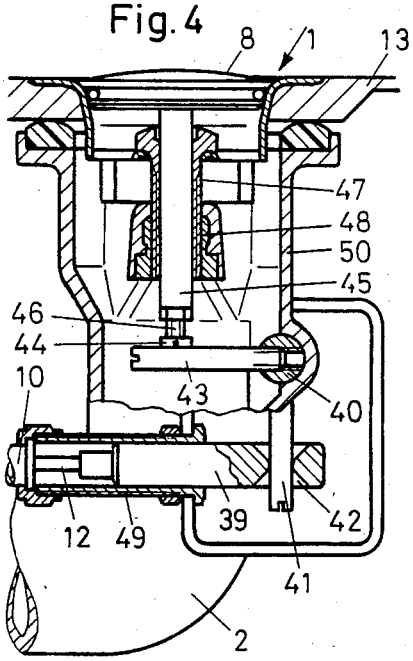
FIG. 4 is a side view, partly in axial section, of the drain valve.
Figure 5:
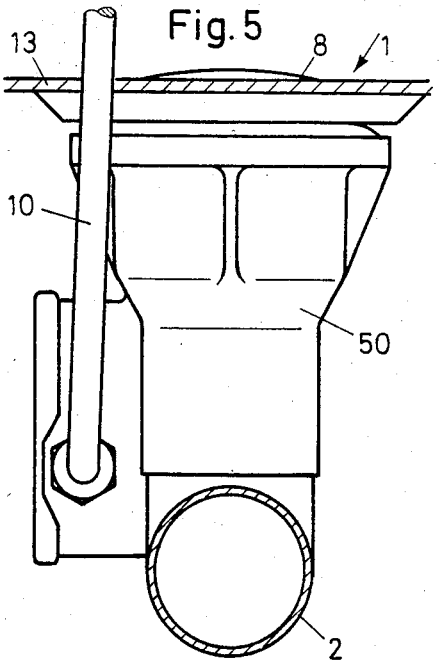
FIG. 5 is a rear view of a drain valve.

As shown in FIGS. 4 and 5, the drain side end of Bowden draw tube 10 is attached to housing 50 of drain valve 1 by means of a casing 49, and the corresponding end of Bowden cable 12 is attached to a pusher 39 easily slidable in axial direction in casing 49. Pusher 39 grasps a lever 41 pivotable about a horizontal axle 40, the lever projecting perpendicularly into a double conical bore 42 of pusher 39. Connected to axle 40 is a second lever 43 which is rotated about 90°, and which supports the head 44 of a screw 45 axially screwed into shaft 45 of valve body 8. Shaft 45 of valve body 8 is seated for easy axial movement in a guideway 47, which is screwed into a central casing 48. If a traction movement is carried out on Bowden cable 12 by rotation of turn knob 6, lever 43 pivots upwardly and thereby lifts valve body 8. Upon return movement, lever 43 pivots downwardly, and valve body 8 falls under its own weight.

What is claimed is:

1. Drain and overflow device for bathtubs having a drain valve (1) and a turn knob (6) adjacent to an overflow (4), a body (8) of said drain valve being lifted into open position by rotation of said turn knob by means of a Bowden draw tube (10), wherein (a) a conduit (11) for said overflow is formed at least partly as a bellows (5) so as to enable adaptation of the length and orientation of said overflow to bathtubs of diverse dimensions;

(b) a flexible Bowden cable (12) being entirely contained within said Bowden draw tube (10) and being operably rotatably connected to a rigid, axially slidable cable bolt (28) having an axial bore (33) containing a bearing (34) to which said Bowden cable (12) is attached, said bearing (34) being rotatable relative to said cable bolt (28), whereby twisting of said Bowden cable (12) upon rotation of said cable bolt (28) is obviated.

2. Device according to claim 1, wherein said bellows (5) is inserted between an overflow housing (15) and an overflow pipe (14).

3. Device according to claim 1, comprising a disc (36) with a central recess (37) on the inner transverse plane (35) of said bearing (34), said Bowden cable (12) being rotatably attached to said disc.

* * * * *